US012460490B2

(12) United States Patent
Kossa et al.

(10) Patent No.: US 12,460,490 B2
(45) Date of Patent: Nov. 4, 2025

(54) SLIP ANCHOR, METHOD, AND SYSTEM

(71) Applicant: Baker Hughes Oilfield Operations LLC, Houston, TX (US)

(72) Inventors: Edward J. Kossa, Huffman, TX (US); Gary L. Anderson, Dublin, OH (US); Christopher Young, Spring, TX (US); Larry Urban, Santa Fe, TX (US); Frank Maenza, Houston, TX (US)

(73) Assignee: Baker Hughes Oilfield Operations LLC, Houston, TX (US)

( * ) Notice: Subject to any disclaimer, the term of this patent is extended or adjusted under 35 U.S.C. 154(b) by 41 days.

(21) Appl. No.: 18/524,985

(22) Filed: Nov. 30, 2023

(65) Prior Publication Data

US 2025/0179888 A1 Jun. 5, 2025

(51) Int. Cl.
*E21B 23/01* (2006.01)

(52) U.S. Cl.
CPC ..... *E21B 23/01* (2013.01)

(58) Field of Classification Search
CPC ..... E21B 23/01; E21B 33/129; E21B 33/1291
See application file for complete search history.

(56) References Cited

U.S. PATENT DOCUMENTS 4,762,177 A * 8/1988 Smith, Jr. ..... E21B 23/01 166/216
4,813,486 A 3/1989 Wyatt et al.
6,241,017 B1 6/2001 Doane et al.
6,378,606 B1 * 4/2002 Swor ..... E21B 33/1292 166/134
7,503,388 B2 * 3/2009 Fay ..... E21B 31/18 294/86.27
9,260,936 B1 * 2/2016 Branton ..... F16J 15/166
9,752,418 B2 * 9/2017 Meador ..... E21B 33/1291
2006/0278404 A1 * 12/2006 Fay ..... E21B 23/01 166/213
2007/0125550 A1 6/2007 Campbell et al.
2015/0090441 A1 * 4/2015 Lovslett ..... E21B 33/1295 166/216
2016/0251921 A1 9/2016 Macleod et al.
2017/0145780 A1 * 5/2017 Castro ..... E21B 33/134
(Continued)

OTHER PUBLICATIONS

Notification of Transmittal of the International Search Report and the Written Opinion of the International Searching Authority, or the Declaration; PCT/US2024/057233; Mail date: Feb. 22, 2025; 10 pages.

*Primary Examiner* — Shane Bomar
(74) *Attorney, Agent, or Firm* — Baker Hughes Patent Organization

(57) ABSTRACT

A slip body includes a first plurality of ramps a second plurality of ramps. An anchor, includes a first compression body, and a second compression body, at least one being movable relative to the other, and a slip body disposed between the first and second compression bodies. A method for anchoring a tool in a borehole, including disposing the anchor above in the borehole, reducing a distance between the first and second compression bodies, camming against the first plurality of ramps and/or the second plurality of ramps of the slip body to move the slip body radially. A wellbore system, including a borehole in a subsurface formation, a string in the borehole, and a slip as described above, disposed within or as a part of the string.

26 Claims, 9 Drawing Sheets

(56) References Cited

U.S. PATENT DOCUMENTS

| | | | | |
|---|---|---|---|---|
| 2018/0179851 | A1* | 6/2018 | Davies | E21B 23/01 |
| 2019/0169951 | A1* | 6/2019 | Frazier | E21B 43/26 |
| 2021/0115749 | A1* | 4/2021 | Sanchez | E21B 34/14 |
| 2021/0270099 | A1* | 9/2021 | Mhaskar | E21B 33/1291 |
| 2024/0011362 | A1* | 1/2024 | Silva | E21B 17/06 |

* cited by examiner

SLIP ANCHOR, METHOD, AND SYSTEM

BACKGROUND

In the resource recovery and fluid sequestration industries anchoring is a common requirement. Tools including slips have been used for decades, the slips moving longitudinally and radially at the same time along a ramp. Such devices work well but also suffer from uneven loading and can damage casing. In view of the strong and continuous need for anchoring in a wellbore environment, the art is always receptive to new technologies that improve performance.

SUMMARY

An embodiment of a slip body, including a radially outward engagement surface, a first plurality of ramps along a first lateral surface of the slip body, and a second plurality of ramps along a second lateral surface of the slip body.

An embodiment of an anchor, including a first compression body, a second compression body, at least one of the first compression body and the second compression body being movable relative to the other of the first compression body and the second compression body, and a slip body disposed between the first compression body and the second compression body, the slip body having a first plurality of ramps along a first lateral surface of the slip body, and a second plurality of ramps along a second lateral surface of the slip body.

An embodiment of a method for anchoring a tool in a borehole, including disposing the anchor in the borehole, reducing a distance between the first compression body and the second compression body, camming against the first plurality of ramps and/or the second plurality of ramps of the slip body to move the slip body radially.

An embodiment of a wellbore system, including a borehole in a subsurface formation, a string in the borehole, and a slip, disposed within or as a part of the string.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1:
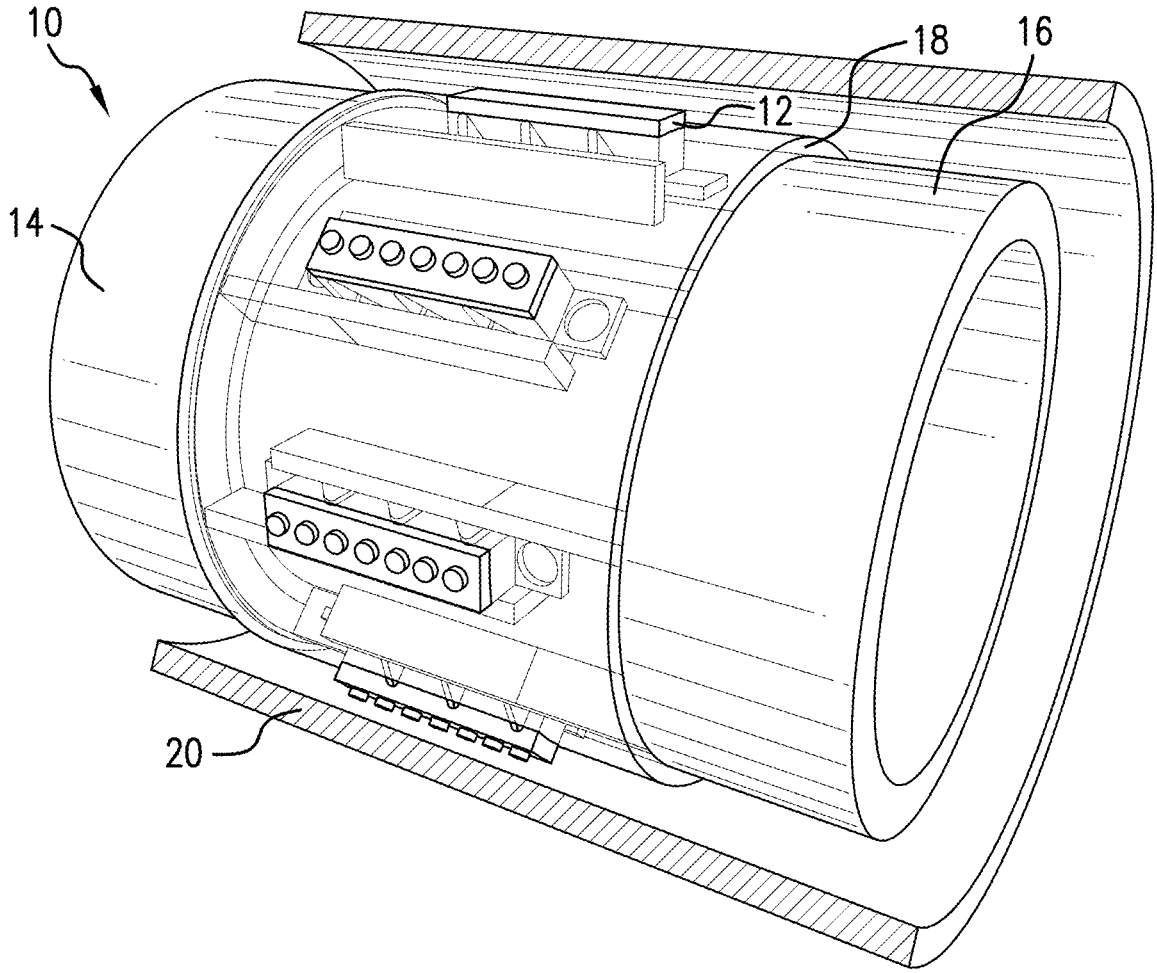
FIG. 1 is a perspective view of an anchor as disclosed herein.
Figure 6:
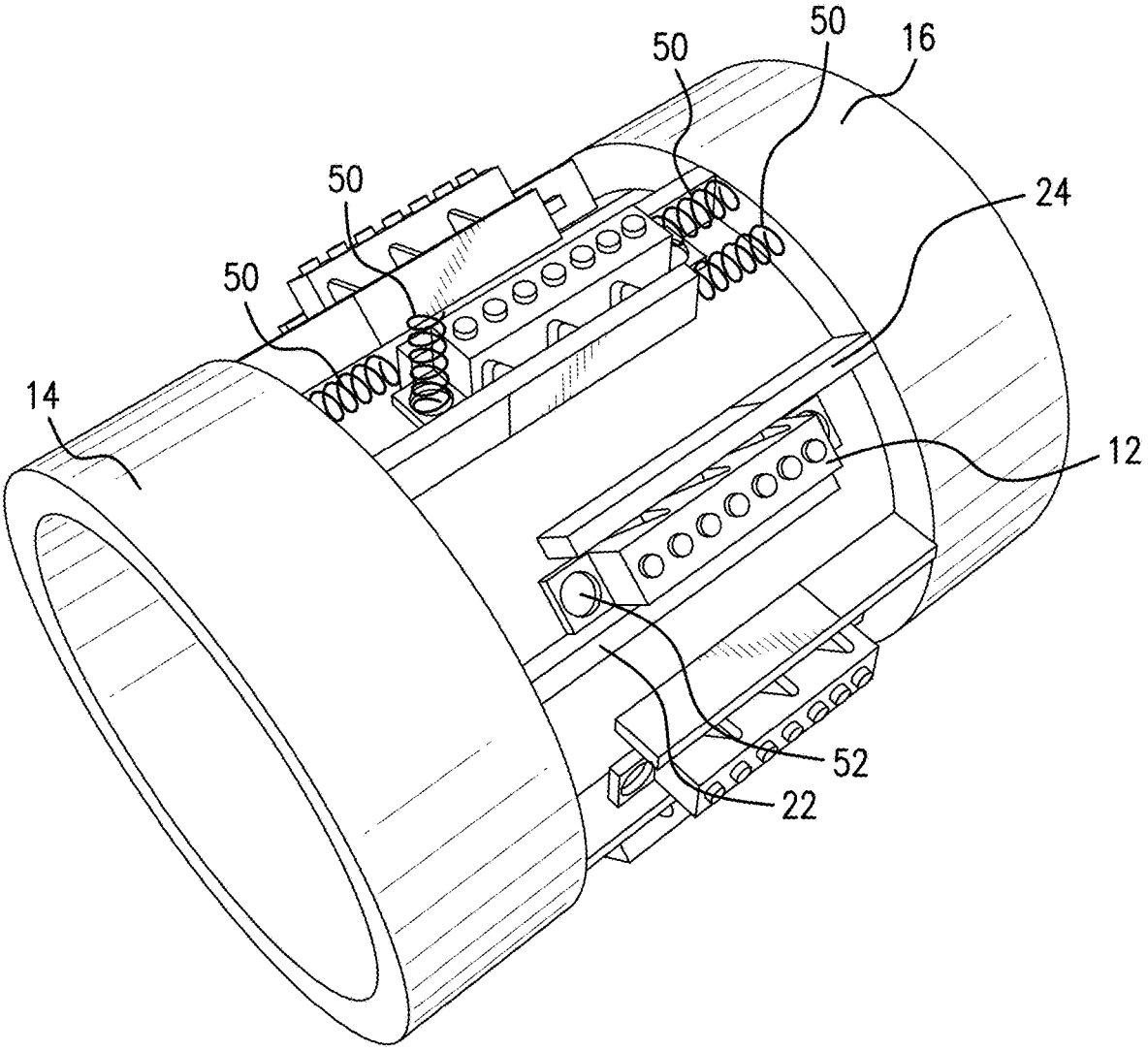
FIG. 6 is a perspective view of the anchor illustrated in FIG. 1, with the slip cage removed.

Referring to FIG. 1, an anchor 10 is illustrated. Anchor 10 comprises a slip 12, a first compression body 14, a second compression body 16, and a slip cage 18. The slip 12 or a plurality of slips 12 are configured to extend directly radially outwardly of the anchor 10, which improves equal loading along the slips 12 and reduces deformations of a parent casing 20 within which the anchor 10 is set. It should be appreciated that the slip 12 may be of any length as desired and will function similarly. Referring also to FIG. 6, the slip cage 18 has been removed to make perception of the other components of the anchor 10 easier. As illustrated, each compression body 14 and 16 includes a slip engager 22 and 24, respectively for one slip 12. The engagers 22 and 24 are configured to cause the slip 12 to move radially outwardly upon relative axial movement of the engagers 22 and 24. In an embodiment the movement is due to one or the other of the compression bodies 14 and 16 moving toward the other compression body or both of the compression bodies moving to reduce a distance between them. The bodies 14 and 16 may be moved by set down weight, hydraulic input, electrical input, etc.

Figure 2A:
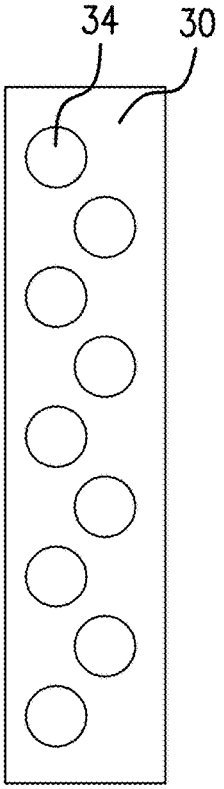
FIG. 2A is a plan view illustrating an alternate insert arrangement.
Figure 2B:
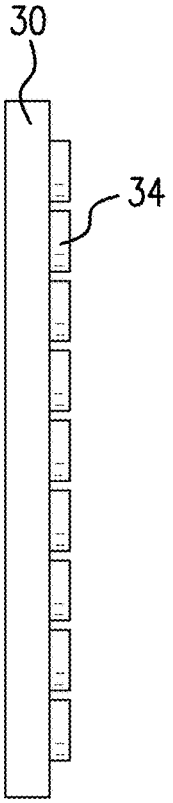
FIG. 2B is a side view of FIG. 2A.
Figure 3A:
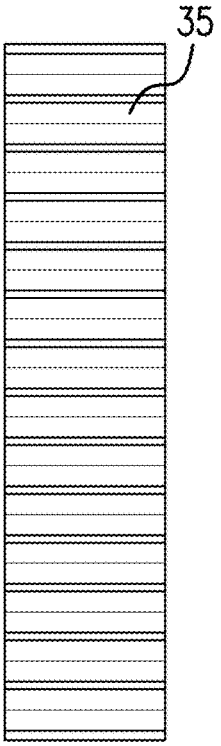
FIG. 3A is a plan view illustrating another alternate insert arrangement.
Figure 3B:
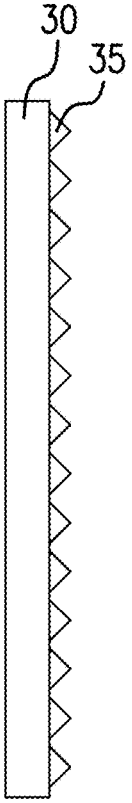
FIG. 3B is a side view of FIG. 3A.
Figure 4A:
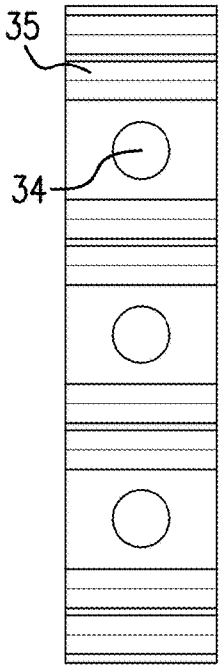
FIG. 4A is a plan view illustrating another alternate arrangement with wickers and inserts.
Figure 4B:
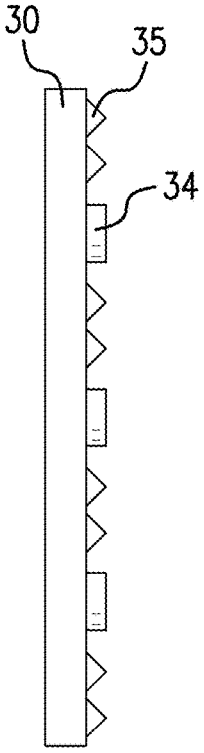
FIG. 4B is a side view of FIG. 4A.
Figure 5A:
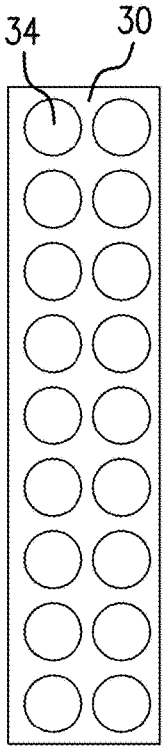
FIG. 5A is a plan view illustrating another alternate arrangement using wickers instead of inserts.
Figure 5B:
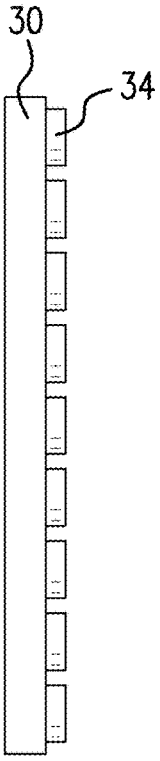
FIG. 5B is a side view of FIG. 5A.
Figure 7:
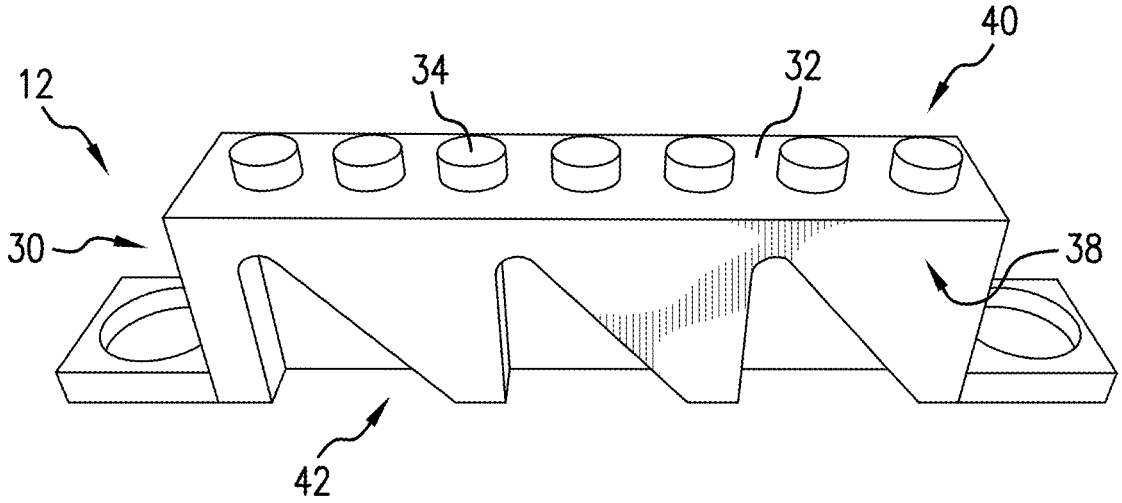
FIG. 7 is a view of a slip as disclosed herein.
Figure 8:
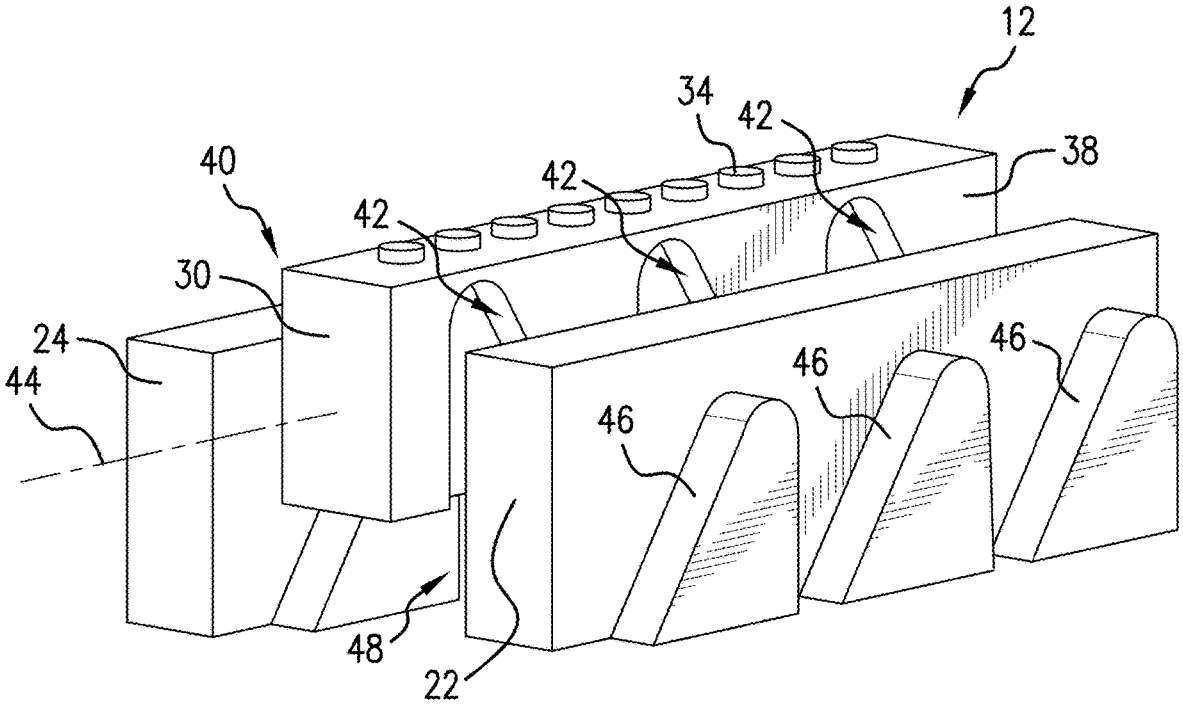
FIG. 8 is a schematic view that shows the slip of FIG. 3 disposed between two slip engagers.

Referring to FIGS. 7 and 8, the slip 12 will be better understood. Slip 12 comprises a slip body 30 having a longitudinal extent. The slip 12 further includes an engagement surface 32 that is radially outwardly disposed relative to the anchor 10. The surface 32 in some embodiments will be provided with an insert 34 such as a carbide insert. Some embodiments may include just one insert while other embodiments will include a plurality of inserts. Inserts 34 may be arranged as desired to spread load into the casing 20 (see FIG. 1). In some embodiments, the inserts 34 may be disposed in a single line of inserts (FIG. 1), while in other embodiments the slip 12 may be provided with a double line (or more) of inserts 34 (FIGS. 2A and 2B). Further, in some embodiments, the inserts 34 may be staggered (FIGS. 3A and 3B). In another embodiment wickers 35 may be used in combination with (FIGS. 4A and 4B) or instead of (FIGS. 5A and 5B) inserts 34. In an embodiment the wickers 35 may be of a 45-degree construction to secure unidirectional functionality. The inserts 34 may be of any desired number along the line, with seven illustrated in FIG. 3 and nine illustrated in FIG. 4, for example. The slip 12 includes a first lateral surface 38 and a second lateral surface 40. At least one of the lateral surfaces 38, 40 will exhibit a plurality of ramps 42 thereon. In some embodiments, both first and second lateral surfaces will exhibit a plurality of ramps 42. The plurality of ramps 42 may be any number as desired but is illustrated as three for convenience. The ramps 42 are, in an embodiment, recessed into the surface 38 and/or 40 and provide an angle in a range of about 15 degrees to about 75 degrees measured from a line parallel with a longitudinal axis 44 of the slip body 30. The ramps 42 are configured to interact with cam surfaces 46 and 48 on engagers 22 and 24. This can be easily appreciated in FIG. 8. When assembled, the ramps 42 and cam surfaces 46 and 48 substantially nest so that when the engagers are shifted to overlap each other more in the longitudinal direction, the slip 12 will move radially outwardly due to the ramp 42 sliding on cam surface 46, for example. Cam surfaces 46 and 48 (cam surfaces 48 are indicated by arrow on FIG. 8 but cannot actually be seen on the Figure. They are the same as cam surfaces 46 and protrude similarly on the back side of the engager 22 but angle in the opposite direction to nest with ramps 42 that can been seen in the figure) are proud of the engagers 22 and 24 as illustrated and extend into the lateral sides 38 and 40 into ramps 42 but it is to be appreciated that the directions of the recesses and cams could be reversed with the same functionality. More specifically, the cam surfaces could be recessed into the engagers 22 and 24 and the ramps 42 could be proud of the surfaces 38 and 40.

In some embodiments, the directions of the ramps 42 on either lateral side of a slip body 30 will be arranged so that the angles will be opposite each other. This helps with load distribution.

Figure 9:
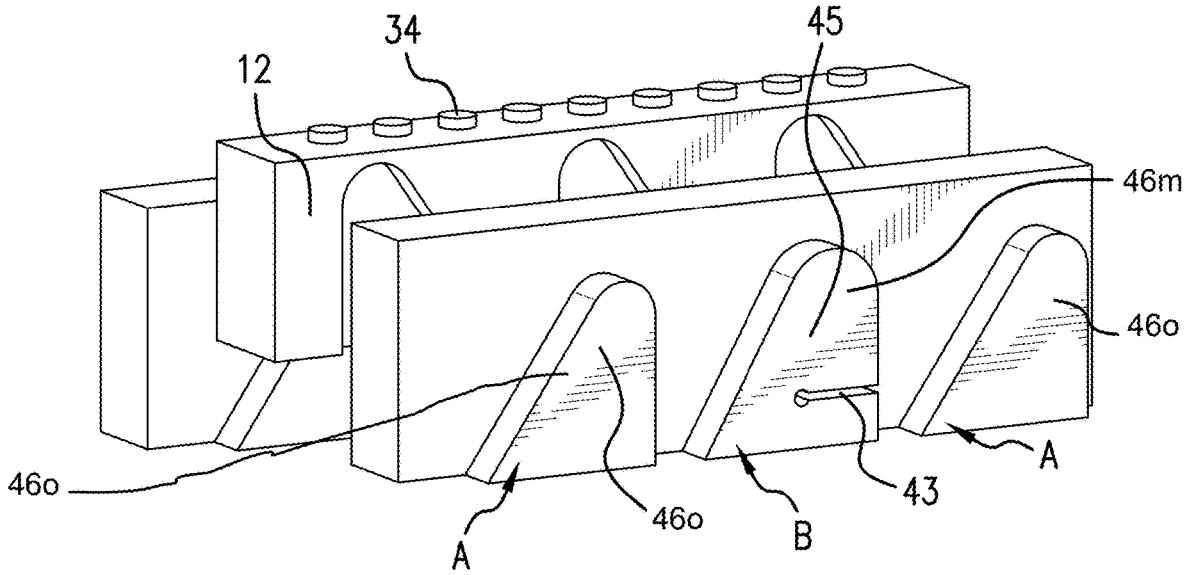
FIG. 9 is a view of the slip illustrating differing angles of the plurality of ramps.
Figure 10:
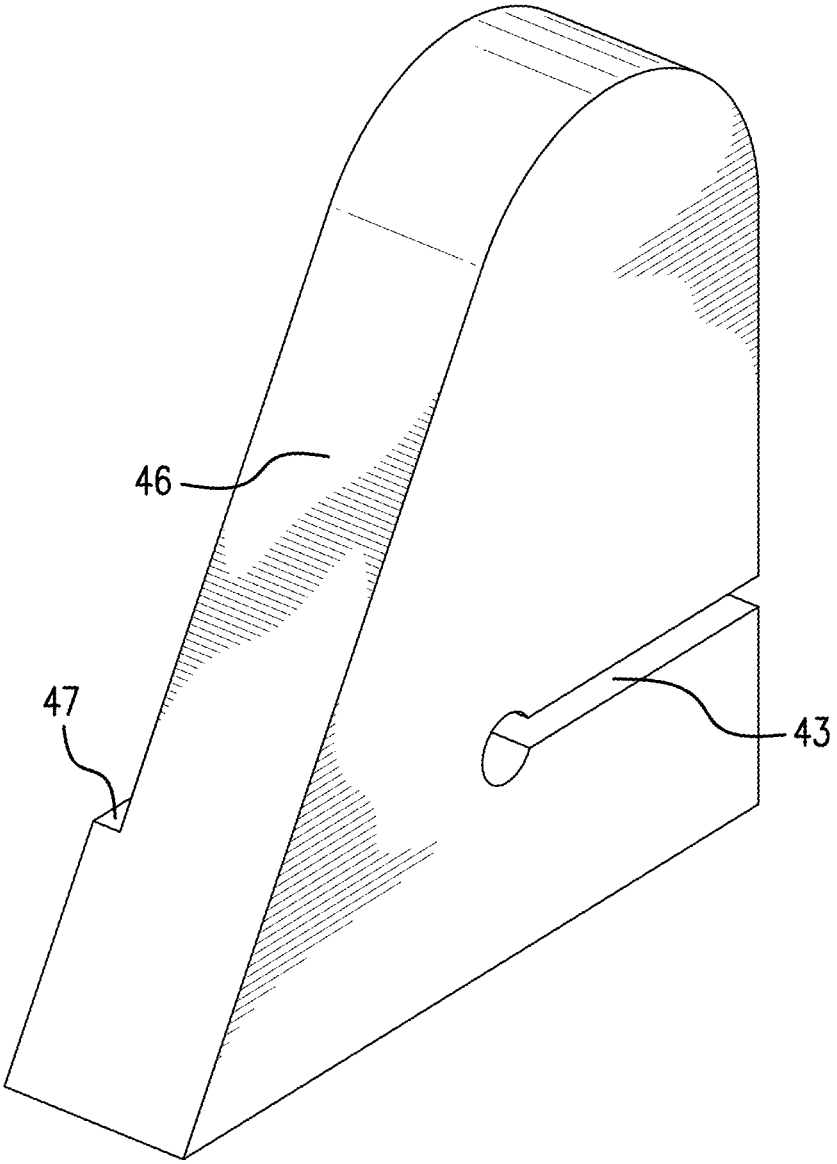
FIG. 10 is an enlarged view of a portion of FIG. 9.

It is further contemplated that one of each of the plurality of ramps 42 could have differing angles among them (see FIG. 9). In one example, the differing degree angles become steeper toward a longitudinal middle of the lateral surface when measured from a line parallel to a longitudinal axis of the slip body 30. Specifically referring to FIG. 9, there are three cam surfaces 46 that are configured to interact with the three ramps 42 in the embodiment illustrated. The longitudinally outer scam surfaces, identified as 46*o* have a first angle A (55 degrees in the illustration) while the middle ramp identified as 46*m* has an angle B (65 degrees in the illustration) initially. Angle B is steeper than angle A and accordingly causes a mid area of the slip 12 to load up the inserts 34 earlier than the end areas of the slip 12. It is to be noted that the ramp 46*m* also includes a slot 43 therein and a portion 45 of the ramp 46*m* is cut away 47 (for example, using an electric discharge machining process) from the slip body 30 so that the portion 45 of the ramp 46*m* can flex (thereby closing the slot 43) or otherwise formed separately (for example, through an additive manufacturing process) when sufficient load is placed thereon, which causes the angle B to be reduced toward or into equivalence with the angle A, whereby an even load on all inserts 34 is achieved for final setting. Reference is made to FIG. 10 to illustrate the cut away. More ramps 42 and more graded angles are contemplated with similar results of loading more centrally located inserts 34 first and progressively loading more outwardly located inserts 34 as overall load increases on the slip 12. Ultimately, the load across all inserts 34 will be roughly even as the various slots 43 deform and allow the ramp angles to become similar.

In each of the embodiments, the slip 12 is moved radially outwardly by the reduction in distance between the compression bodies 14 and 16, and the related amount of longitudinal overlap of the engagers, with a greater overlap being associated with the slip 12 being moved radially outwardly as illustrated. This can be effected through set down weight or any other actuation configurations that displace one portion of the device relative to another. In order to maintain the slip 12 in a run-in position during the run in procedure, biasers 50 may be added (see FIG. 6). Biasers 50 may be compression springs. They may be located between a foot 52 of slip 12 and the slip cage 18, may be between the slip 12 and the compression bodies 14 or 16, or may be between the slip engagers 22 and 24 and the opposing compression bodies 16 and 14, respectively. Each of the positions are illustrated in FIG. 2. While all could be used together, it is more likely that only the radial springs, or the axial springs would be employed in particular embodiments.

Figure 11:
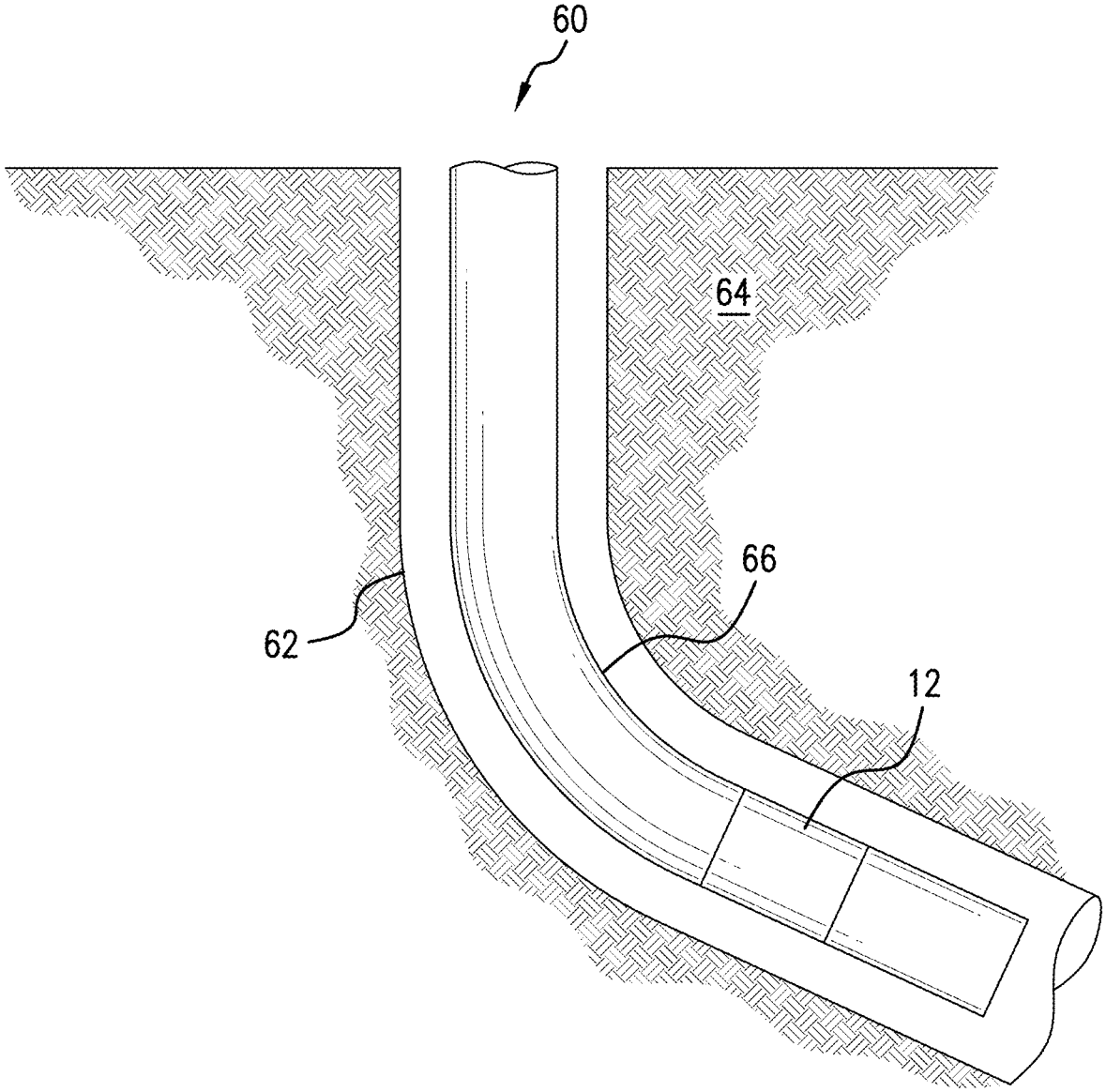
FIG. 11 is a view of a borehole system including a slip as disclosed herein.

Referring to FIG. 11, a borehole system 60 is illustrated. The system 60 comprises a borehole 62 in a subsurface formation 64. A string 66 is disposed within the borehole 62. A slip 12 as disclosed herein is disposed within or as a part of the string 66.

Set forth below are some embodiments of the foregoing disclosure:

Embodiment 1: A slip body, including a radially outward engagement surface, a first plurality of ramps along a first lateral surface of the slip body, and a second plurality of ramps along a second lateral surface of the slip body.

Embodiment 2: The slip body as in any prior embodiment, wherein the engagement surface includes a plurality of inserts arranged in a single line longitudinally along the slip body.

Embodiment 3: The slip body as in any prior embodiment, wherein the first plurality of ramps and the second plurality of ramps are angled in opposing directions along the slip body.

Embodiment 4: The slip body as in any prior embodiment, wherein the first plurality of ramps and/or the second plurality of ramps have the same degree of angle measured from a line parallel to a longitudinal axis of the slip body.

Embodiment 5: The slip body as in any prior embodiment, wherein one or more ramps of the first plurality of ramps and/or the second plurality of ramps have a different degree of angle measured from a line parallel to a longitudinal axis of the slip body than other ramps of the first plurality of ramps and/or the second plurality of ramps.

Embodiment 6: The slip body as in any prior embodiment, wherein one or more ramps of the first plurality of ramps and/or the second plurality of ramps are configured to flex to change an angle of that ramp.

Embodiment 7: The slip body as in any prior embodiment, wherein the one or more ramps configured to flex are configured to adjust their ramp angles to ramp angles of adjacent ramps of the first plurality of ramps and/or the second plurality of ramps.

Embodiment 8: An anchor, including a first compression body, a second compression body, at least one of the first compression body and the second compression body being movable relative to the other of the first compression body and the second compression body, and a slip body disposed between the first compression body and the second compression body, the slip body having a first plurality of ramps along a first lateral surface of the slip body, and a second plurality of ramps along a second lateral surface of the slip body.

Embodiment 9: The anchor as in any prior embodiment, wherein the first compression body includes a first slip engager extending toward the second compression body, the first slip engager having a first plurality of cam surfaces complementary to the first plurality of ramps or the second plurality of ramps.

Embodiment 10: The anchor as in any prior embodiment, wherein the second compression body includes a second slip engager extending toward the first compression body, the second slip engager having a second plurality of cam surfaces complementary to the other of the first plurality of ramps or the second plurality of ramps.

Embodiment 11: The anchor as in any prior embodiment, wherein the first plurality of ramps and the second plurality of ramps are angled in opposing directions along the slip body.

Embodiment 12: The anchor as in any prior embodiment, wherein one of the first plurality of cam surfaces and/or the second plurality of cam surfaces have differing degrees of angles measured from a line parallel to a longitudinal axis of the slip body from others of the first plurality of cam surfaces and/or the second plurality of cam surfaces.

Embodiment 13: The anchor as in any prior embodiment, wherein the differing degree angles become steeper toward a longitudinal middle of the lateral surface when measured from a line parallel to a longitudinal axis of the slip body.

Embodiment 14: The anchor as in any prior embodiment, wherein one or more ramps of the first plurality of ramps and/or the second plurality of ramps have a different degree of angle measured from a line parallel to a longitudinal axis of the slip body than other ramps of the first plurality of ramps and/or the second plurality of ramps.

Embodiment 15: The anchor as in any prior embodiment, wherein one or more ramps of the first plurality of ramps and/or the second plurality of ramps are configured to flex to change an angle of that ramp.

Embodiment 16: The anchor as in any prior embodiment, wherein the one or more ramps configured to flex are configured to adjust their ramp angles to ramp angles of adjacent ramps of the first plurality of ramps and/or the second plurality of ramps.

Embodiment 17: The anchor as in any prior embodiment, wherein the slip body includes a single line of inserts.

Embodiment 18: The anchor as in any prior embodiment, wherein the line of inserts is longitudinally oriented of the slip body.

Embodiment 19: The anchor as in any prior embodiment, further including a slip cage disposed about the slip body.

Embodiment 20: The anchor as in any prior embodiment, further including a biaser disposed between the slip body and the slip cage.

Embodiment 21: The anchor as in any prior embodiment, further including a biaser disposed between the slip body and the first compression body.

Embodiment 22: The anchor as in any prior embodiment, further including a biaser disposed between the slip body and the second compression body.

Embodiment 23: The anchor as in any prior embodiment, further including a biaser disposed between the first slip engager and the second compression body.

Embodiment 24: A method for anchoring a tool in a borehole, including disposing the anchor as in any prior embodiment in the borehole, reducing a distance between the first compression body and the second compression body, camming against the first plurality of ramps and/or the second plurality of ramps of the slip body to move the slip body radially.

Embodiment 25: The method as in any prior embodiment, where in the camming is in a first direction for the first plurality of ramps and a second direction different than the first direction for the second plurality of ramps.

Embodiment 26: A wellbore system, including a borehole in a subsurface formation, a string in the borehole, and a slip as in any prior embodiment, disposed within or as a part of the string.

The use of the terms "a" and "an" and "the" and similar referents in the context of describing the invention (especially in the context of the following claims) are to be construed to cover both the singular and the plural, unless otherwise indicated herein or clearly contradicted by context. Further, it should be noted that the terms "first," "second," and the like herein do not denote any order, quantity, or importance, but rather are used to distinguish one element from another. The terms "about", "substantially" and "generally" are intended to include the degree of error associated with measurement of the particular quantity based upon the equipment available at the time of filing the application. For example, "about" and/or "substantially" and/or "generally" can include a range of ±8% of a given value.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited.

What is claimed is:

1. A slip body, comprising:

a radially outward engagement surface;

a first plurality of ramps each having a first angle direction along a first lateral surface of the slip body; and a second plurality of ramps each having a second angle direction different than the first angle direction along a second lateral surface of the slip body.

2. The slip body as claimed in claim 1, wherein the engagement surface includes a plurality of inserts arranged in a single line longitudinally along the slip body.

3. The slip body as claimed in claim 1, wherein the first plurality of ramps and the second plurality of ramps are angled in opposing directions along the slip body.

4. The slip body as claimed in claim 1, wherein the first plurality of ramps and/or the second plurality of ramps have the same degree of angle measured from a line parallel to a longitudinal axis of the slip body.

5. The slip body as claimed in claim 1, wherein one or more ramps of the first plurality of ramps and/or the second plurality of ramps have a different degree of angle measured from a line parallel to a longitudinal axis of the slip body than other ramps of the first plurality of ramps and/or the second plurality of ramps.

6. The slip body as claimed in claim 1, wherein one or more ramps of the first plurality of ramps and/or the second plurality of ramps are configured to flex to change an angle of that ramp.

7. The slip body as claimed in claim 6, wherein the one or more ramps configured to flex are configured to adjust their ramp angles to ramp angles of adjacent ramps of the first plurality of ramps and/or the second plurality of ramps.

8. An anchor, comprising:

a first compression body;

a second compression body, at least one of the first compression body and the second compression body being movable relative to the other of the first compression body and the second compression body; and a slip body disposed between the first compression body and the second compression body, the slip body having a first plurality of ramps each having a first angle direction along a first lateral surface of the slip body; and a second plurality of ramps each having a second angle direction different than the first angle direction along a second lateral surface of the slip body.

9. The anchor as claimed in claim 8, wherein the first compression body includes a first slip engager extending toward the second compression body, the first slip engager having a first plurality of cam surfaces complementary to the first plurality of ramps or the second plurality of ramps.

10. The anchor as claimed in claim 9, wherein the second compression body includes a second slip engager extending toward the first compression body, the second slip engager having a second plurality of cam surfaces complementary to the other of the first plurality of ramps or the second plurality of ramps.

11. The anchor as claimed in claim 8, wherein the first plurality of ramps and the second plurality of ramps are angled in opposing directions along the slip body.

12. The anchor as claimed in claim 10, wherein one of the first plurality of cam surfaces and/or the second plurality of cam surfaces have differing degrees of angles measured from a line parallel to a longitudinal axis of the slip body from others of the first plurality of cam surfaces and/or the second plurality of cam surfaces.

13. The anchor as claimed in claim 12, wherein the differing degree angles become steeper toward a longitudinal middle of the lateral surface when measured from a line parallel to a longitudinal axis of the slip body.

14. The anchor as claimed in claim 8, wherein one or more ramps of the first plurality of ramps and/or the second plurality of ramps have a different degree of angle measured from a line parallel to a longitudinal axis of the slip body than other ramps of the first plurality of ramps and/or the second plurality of ramps.

15. The anchor as claimed in claim 8, wherein one or more ramps of the first plurality of ramps and/or the second plurality of ramps are configured to flex to change an angle of that ramp.

16. The anchor as claimed in claim 15, wherein the one or more ramps configured to flex are configured to adjust their ramp angles to ramp angles of adjacent ramps of the first plurality of ramps and/or the second plurality of ramps.

17. The anchor as claimed in claim 8, wherein the slip body includes a single line of inserts.

18. The anchor as claimed in claim 17, wherein the line of inserts is longitudinally oriented of the slip body.

19. The anchor as claimed in claim 8, further including a slip cage disposed about the slip body.

20. The anchor as claimed in claim 19, further including a biaser disposed between the slip body and the slip cage.

21. The anchor as claimed in claim 8, further including a biaser disposed between the slip body and the first compression body.

22. The anchor as claimed in claim 21, further including a biaser disposed between the slip body and the second compression body.

23. The anchor as claimed in claim 9, further including a biaser disposed between the first slip engager and the second compression body.

24. A method for anchoring a tool in a borehole, comprising:

disposing the anchor as claimed in claim 8 in the borehole;

reducing a distance between the first compression body and the second compression body;

camming against the first plurality of ramps and/or the second plurality of ramps of the slip body to move the slip body radially.

25. The method as claimed in claim 24, where in the camming is in a first direction for the first plurality of ramps and a second direction different than the first direction for the second plurality of ramps.

26. A wellbore system, comprising:

a borehole in a subsurface formation;

a string in the borehole; and a slip as claimed in claim 1, disposed within or as a part of the string.

* * * * *